United States Patent [19]

Johnson

[11] 3,950,846

[45] Apr. 20, 1976

[54] METHOD OF FORMING A DEFORMED, INTEGRAL SWITCHING DEVICE

[75] Inventor: Wendell C. Johnson, Topanga, Calif.

[73] Assignee: Xerox Corporation, Stamford, Conn.

[22] Filed: Sept. 23, 1974

[21] Appl. No.: 508,486

[52] U.S. Cl. ..... 29/630 R; 29/622; 29/630 B; 200/5 A; 200/159 B

[51] Int. Cl.[2] ..... H01R 9/00

[58] Field of Search ..... 29/630 B, 630 R, 622; 200/5 R, 5 A, 159 R, 159 A, 159 B; 113/116 R; 267/159, 158, 164, 160; 156/6

[56] References Cited

UNITED STATES PATENTS

| | | | |
|---|---|---|---|
| 1,593,511 | 7/1926 | Spencer | 267/159 |
| 2,516,236 | 7/1950 | Moorehead et al. | 267/159 |
| 2,571,170 | 10/1951 | Stilwell | 267/159 |
| 2,604,316 | 7/1952 | O'Brien et al. | 267/159 |
| 3,279,043 | 10/1966 | Wirt | 113/116 |
| 3,582,596 | 6/1971 | Woodhead | 200/159 R |
| 3,600,528 | 8/1971 | Leposavic | 200/159 B |
| 3,643,041 | 2/1972 | Jackson | 200/159 B |
| 3,697,711 | 10/1972 | Tetrick | 200/159 B |

OTHER PUBLICATIONS

Metals Handbook, 8th Ed., Vol. 2, Heat Treating, Cleaning and Finishing, pp. 284–292.

*Primary Examiner*—C. W. Lanham
*Assistant Examiner*—James R. Duzan
*Attorney, Agent, or Firm*—John E. Beck; Terry J. Anderson; Leonard Zalman

[57] ABSTRACT

A method of forming a switching device having a movable contact that is an integral part of a metallic support substrate and is supported above the support substrate by a plurality of spring-like legs that are also an integral part of the support substrate. One or more of the switching devices is produced by forming one or more groups of curved, unconnected radially extending slots in a metallic substrate to define support legs, plastically deforming the legs defined by the slots past their elastic limit, and then precipitation hardening the complete structure. The slots can be formed by a photomasking technique followed by an acid etch with the etch being performed from both sides of the metallic support substrate. To provide a desired tactile response characteristic, and to assure movement of a central portion of the switching device past the plane of the metallic support substrate, a portion of each of the legs defined by the slots may be removed to thin that portion of each leg. The plastic deformation may be performed in a male-female die mechanism.

2 Claims, 12 Drawing Figures

METHOD OF FORMING A DEFORMED, INTEGRAL SWITCHING DEVICE

BACKGROUND OF THE INVENTION

U.S. Pat. Nos. 3,600,528, 3,643,041, 3,467,923, and 3,697,711 describe keyboards or switches having a movable contact member that is an integral part of a planar supporting substrate. Formerly, a plurality of discrete componets, i.e., plungers and springs, were united to form a relatively complex electro-mechanical linkage. In the former structures the alleged advantages of the structures described in the patents are that they can be manufactured cheaply, with reduced tedium to the assembling personnel, and that they are more reliable.

In a copending U.S. patent application, filed concurrently herewith by the inventor of the present invention and entitled "Switching Device and Keyboard", there is described a novel movable switching element which may be an integral part of a keyboard device using a plurality of such switching elements. The novel switching element is characterized by a set of unconnected, curved slots or apertures radiating outwardly from a central key area of a planar, metallic surface or substrate. The radially extending, unconnecting slots can be sections of a spiral, at least some of which overlap each other. In a preferred form of the switching element, the slots are involutes of a circle which are equally spaced around the central key areas. The slots provide a movable switching element that is strong and very easy to produce, thereby providing an improved switching device. Further, when depressed, the central key area of the switching element rotates, due to the action of the slots, such that a wiping contact with a fixed contact member is achieved with the resulting improved electrical properties.

The aforementioned patent application teaches that the force-displacement characteristics of the movable switching element can be changed by adjusting the length or inner terminus of the radial extending slots. However, even with these adjustments, a structure with movable switching elements having a home position that is on the same plane with the remainder of the metal layer or substrate in, or from which, the switching elements are formed provides only a satisfactory mechanical sensory feedback signal through the fingertips of the operator. When depressing the switching elements, as through keys, it is best that the operator have a sufficient sensory feedback signal such that the operator can tell when a key has been depressed sufficiently to produce the desired electrical switching action. It is not desirable that the operator know that the switching has occurred through, or by means of, a hard stop action.

OBJECTS OF THE PRESENT INVENTION

It is an object of the present invention to provide a method of producing an improved switching device, a switching device that has an improved tactile feel.

It is a still further object of the present invention to provide a method of constructing a switching element that has an improved sensory feedback.

It is a still further object of the present invention to provide a method of producing a keyboard.

SUMMARY OF THE PRESENT INVENTION

In accordance with the invention, the foregoing objects are achieved by a switching device having a movable switching element that forms an integral part of a planar, metallic supporting substrate but has a central key area displaced from that substrate. The central key area is supported by a plurality of curved support legs which radiate outwardly from the central key area of the switching element. The support legs and the central key area are formed from the metallic substrate surface and remain integral therewith. Preferably, the support legs are equally spaced around the central key area and contact the support substrate at equally spaced points. The central key area is aligned with a fixed contact or another movable contact to provide the desired switching function.

A variable force-displacement characteristic is achieved by displacing the central key area from the metallic supporting substrate such that the central key area occupies a plane substantially parallel to the plane of the substrate. The displacement is achieved by first forming a plurality of unconnected, curved, radially extending slots in the substrate, and then placing the substrate in a properly shaped die and pushing the central key area until the legs (formed by the slots) supporting the central key area are stretched beyond their elastic limit. Due to this stretching beyond the elastic limit of the supporting legs, the central key area assumes a stable or normal position which is in a plane substantially parallel to, but displaced from, the plane of the substrate. The distance between the two planes and the thickness of the supporting legs will determine the force-displacement characteristics of the movable switching element. The force-displacement characteristic can be modified, such as to achieve a harder or stiffer tactile feel, that is, a steeper force-displacement characteristic curve, by prescription hardening the switching elements.

When pressure, assumed to be downward, is applied to the central key area, it is desired that the central key area move downward before the supporting legs move downward. To achieve this objective, a small area of each supporting leg is made thinner than the rest of the supporting leg. This allows the central area to traverse or move downward before a substantial portion of each of the supporting legs move downward to thereby achieve the desired force-displacement characteristic and the necessary switching function.

Although the invention has heretofore been described as a single switching element, it is contemplated that a plurality of such elements could be formed on a metallic substrate and that the substrate be used as a component of a keyboard structure. The central key areas of each switching element of the keyboard would be in a plane substantially parallel to the plane of the substrate. Several such substrates could be used with the central key areas of each in registration with each other and with a fixed contact to thereby provide a multiple switching function.

The foregoing and other objects of the present invention will become apparent from a reading of the following description in light of the accompanying sheets of drawings in which:

DESCRIPTION OF THE PREFERRED EMBODIMENT

Figure 1:
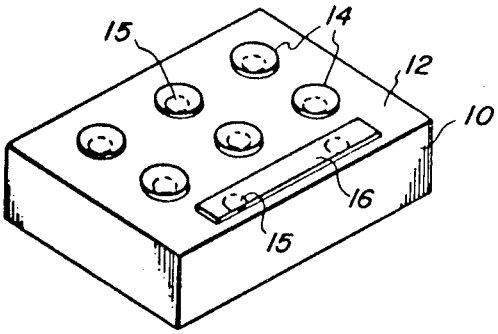
FIG. 1 is a perspective view of a device incorporating the switching devices of the present invention.

With particular reference to FIG. 1, there is presented a data entry device generally indicated as 10, such as a typewriter, calculator, or computer terminal device, in which the invention can be incorporated. The illustrated device includes a keyboard panel 12 having a plurality of keys 14 arranged in a convenient manner to be depressed by the fingertips of an operator, thus entering the required data into the data entry device. Each key has a post 15, shown in phantom, that would contact or be disposed adjacent the movable key or switching elements to be described. The data entry device also may have a spacer or margin bar which is generally indicated as 16.

Figure 2A:
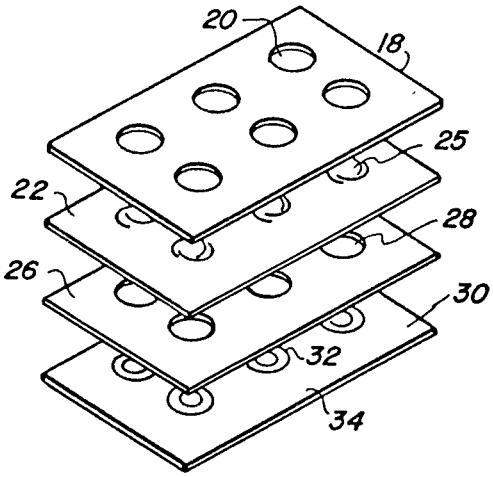
FIG. 2A is an exploded view of one embodiment of a portion of the device of FIG. 1.
Figure 2B:
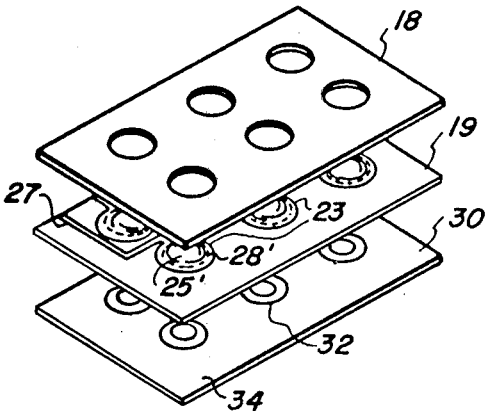
FIG. 2B is an exploded view of another embodiment of a portion of the device of FIG. 1.

Referring now to FIG. 2A, the keyboard 12 of FIG. 1 is shown in greater detail and in an exploded form. The keyboard includes an insulating plate 18 having a plurality of openings 20 therein. Mounted below faceplate 18 is a thin, continuous, metallic sheet or substrate 22, preferably a beryllium copper alloy about ¼ mm thick, which has a plurality of movable switching or contact elements 25 formed therein. The structure of the movable elements 25, and a method of their manufacture, are described in detail hereinafter. Immediately below the plate 22, and preferably in contact therewith, is provided a flat insulating plate 26, which may be formed of any convenient insulating material such as Mylar. Plate 22 has a plurality of holes 28 therein. The sheet 22 and the plate 26 may be integral, such as in a printed circuit board, with the insulating plate having the top surface thereof metallized with a thin, for example, ¼ mm thick, coating of a metal, for example, a beryllium copper alloy. In such a case, as illustrated in FIG. 2B, the coating on the printed circuit board 19 would be etched to provide a plurality of co-planar metallized areas 23, each of which has a movable switching element 25′ formed therein and a conductor 27 leading thereto which conductors are connected to leads (not shown) for maintaining the switching elements 25′ at a desired potential. The insulating plate 19 has a hole 28′ below each of the switching elements 25′.

As shown in FIG. 2A, the openings 20 and the holes 28 each register with a different one of the movable switching elements 25 of the sheet 22. Positioned below the insulating plate 26, and preferably in contact therewith, is a circuit or contact board 30 which may also be a conventional printed circuit board. Contact buttons or rings 32 are formed, as by etching, on the insulating substrate 34 of circuit board 30 and each is positioned in registration with a hole 28, a movable switching element 25, and an aperture 20. The plate 18, the metal sheet 22, the insulating plate 26, and the circuit board 30 form a "sandwich" which is extremely compact and occupies only a thin top layer of the device 10.

Figure 3A:
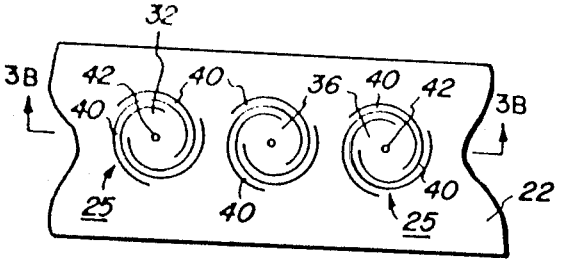
FIG. 3A is a plan view of a portion of the device of FIG. 2.
Figure 3B:
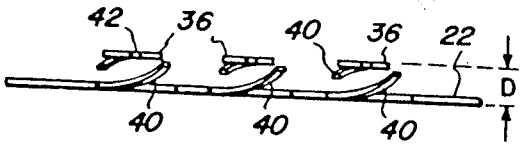
FIG. 3B is a cross-sectional view of the device of FIG. 3A taken along line 3—3.

As shown in FIG. 3A, which is a plane view of a portion of sheet 22, and in FIG. 3B, which is a cross-sectional view taken along line 3—3 of FIG. 3A, each movable switching element 25 includes a central contact or key area 36 which is supported by a plurality of curved legs 40 that originate from equally spaced points of the sheet 22. Legs 40 extend radially inward, preferably at a steadily increasing rate, from the surrounding areas of the metal sheet 22 to define and provide support for the central key area 36. Legs 40 may be in the form of extended or stretched spirals of equal length which support the central key area 36 at points that are equally spaced around the periphery of the central key area and equidistant from a central portion 42 of the central key area. If the movable switching elements 25 are to be used as contact switches, as opposed to capacitive switches, each of the central portions 42 may be in the form of a dimple extending downward toward the circuit board 30.

Figure 8:
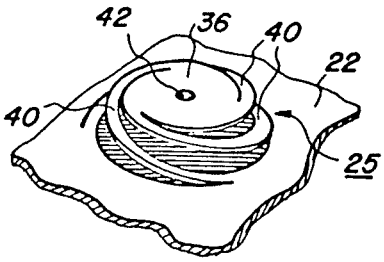
FIG. 8 is a perspective view of a switching element in accordance with the invention.

As shown clearly in FIGS. 3B and 8 each of the central areas 36 lies in a plane that is above the plane from which the support legs 40 originate, that is, above the plane of sheet 22. Preferably, the support legs 40 are three in number and have equal width of about 1 mm. Each of the support legs extends, preferably, for about 325° such that the outer terminus of each support leg, that is, the portion of the support leg adjacent the sheet 22, is adjacent the inner terminus of one of the other support legs, that is, the portion of the support leg adjacent central key area 36. Preferably, the distance D between the plane of the sheet 22 and the plane of central key areas 36 is about 3 mm with the inner terminus of the support legs 40 originating about 4 mm radially outward from central portion 42 and ending about 7 mm radially outward from portion 42. The width and thickness of the support legs, and the degree that they are stretched, that is, the distance D between the plane of sheet 22 and the plane of the central key area 36, determines the force-displacement characteristics of the switching elements 25. If it is desired that different central key areas 36 of the switching elements 25 of FIG. 2 have different force-displacement characteristics, the distance D, or the width and thickness of the supporting legs, or a multiple of these can be changed.

Figure 4A:
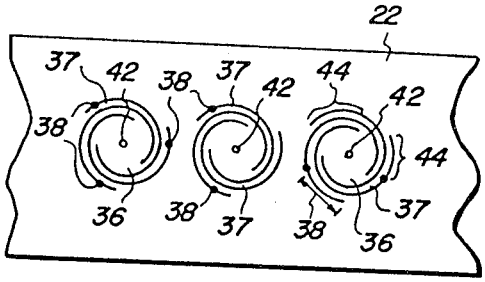
FIG. 4A is a top view of switching elements in accordance with the present invention during one stage of the manufacture thereof.

The method of forming the movable switching elements 25 of FIG. 2 will now be described with reference to FIGS. 4A, 4B and 4C. First, as shown in FIG. 4A, a group of curved, unconnected slots 37 are formed about each of the central key areas 36. Slots 37 define legs 40. The slots 37, preferably three in number and 0.25 mm wide, extend radially outward, preferably at a steadily increasing rate, from the central areas 36. The slots 37, which may be formed by a chemical milling process, may be in the form of a spiral and preferably originate from points that are both equally spaced about the periphery of the central areas 36 and equidistant from the central portion 42 of the central areas 36; the latter distance is preferably 4 mm. Preferably, the slots 37 are involutes of a circle repeated three times at 120° intervals around the central areas 36. The involutes would have X and Y dimensions according to the formula $X = r_o (\sin \phi - \phi \cos)$ and $Y = r_o (\cos \phi + \phi \sin \phi)$, where $r_o$ is the distance from the central portion 42 to the beginning of each spiral and the angle $\phi$ is measured from the point where each of the spirals begins, as shown in FIG. 4C. Still referring to FIG. 4C and to FIG. 4A, the slots preferably are equally spaced in areas where they are adjacent and, as shown, extend for about 325 rotary degrees from start to finish. This placement of slots 37 provides a structure wherein all three slots have portions adjacent each other and equally spaced from each other over areas 44 which are equally spaced around the central key areas 36. If desired, the outer ends of each slot 37 can be extended outwardly or inwardly, or the inner end of each slot may be extended inwardly or outwardly to provide a different spring action, that is, a different force to move the spring a predetermined displacement distance. Obviously, the dimensions given are only exemplary and other dimensions may also be satisfactory.

As shown in FIG. 4A, each of the slots 37 has a small portion 38 of increased width, about 0.01 mm wider. Portions 38, which are equally spaced around the periphery of the central area 36, reduce the thickness of a small portion of each of the supporting legs 40 which the slots 37 define. Preferably, the portions 38 occur near the outer terminus of slots 37, that is, preferably about 5 mm (shown as *l* in FIG. 4A) from the outer terminus of slots 37.

As noted, slots 37 may be formed by a chemical milling process, although other ways of forming slots 37 in sheet 22 or in areas 23, such as silk screening, are satisfactory.

In the chemical milling process for forming slots 37, a chromate-gelatin or other film, which is hardened when exposed to light of a given wavelength, is applied to both sides of the plate 22 or areas 23. Next, a photograph of the slot pattern is placed over each side of the plate 22 or areas 23 followed by exposure of the sides to light, e.g., ultra-violet light, which sets the gelatin in the exposed areas. Care must be taken that the pattern projected on one side is oriented such that is corresponds to the pattern projected on the other side. After exposure to the light, the non-exposed parts of the film, which define the slot pattern, are dissolved, for example, with alcohol or methanol. Subsequently, the unprotected parts of the beryllium copper sheet 22 or areas 23 are etched away by means of an appropriate acid, e.g., nitric acid. Following this, the remainder of the hardened protective film is removed by a solvent. If desired, the etching can be done from only one side of the metal sheet 22 or areas 23. Obviously, the photograph of the slot pattern would include portions 38 or those portions could be produced by a subsequent etching, filing, or other process.

Figure 4B:
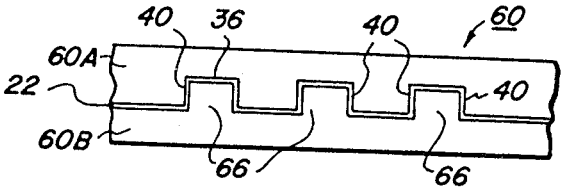
FIG. 4B is a side view of the switching elements of FIG. 4A during a subsequent stage of the manufacture thereof.
Figure 4C:
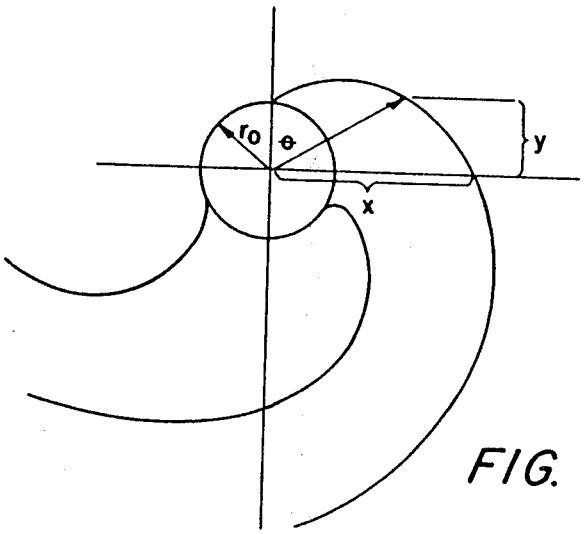
FIG. 4C shows the shape of the slots of FIG. 4A.

Next, the structure shown in FIG. 4A is placed in a forming die 60, as shown in FIG. 4B, which has an upper jaw 60A and a lower jaw 60B. The metal sheet 22 or the circuit board 17 is positioned in the die such that the upper surfaces of the upwardly extending teeth 66 of the lower jaw 60B contact the central key areas 36. Next, the upper jaw, having indentations 67 matching the teeth 66 of the lower jaw 60B, is forced downward to sandwich the metal sheet or circuit board between the upper and lower die portions. The teeth 66 are of uniform and sufficient height to plastically deform the support legs 40 defined by slots 37 when the upper and lower portions of the die are mated; that is, the support legs 40 are stretched past their elastic limit such that after removal from the die 60 the "home" or stable positions of the central areas 36 of the structure of FIG. 4A are in a plane displaced in the "Z" axis from the plane of metal sheet 22 or circuit board 19, as shown in FIG. 3B. Preferably, the teeth 66 have a height of about 3 mm. If it is desired that some of the switching elements have different force-displacement characteristics, some of the teeth 66 may have a different height, i.e., other than the 3 mm given in the example, a minimum height, of course, being needed to produce the required plastic deformation of the support legs 40. Different force-displacement characteristics could also be achieved by making the support legs of different thicknesses or by having their inner terminus nearer to or further from the center portions 42 of the central key areas 36. Also, the tactile stress can be increased by precipitation hardening the sheet 22 or the circuit board 19, such as by heating in a furnace at about 600° for about two hours, after the legs 40 have been plastically deformed or prior to deformation of the legs.

As noted, when the switching elements 25 have been removed from the die 60, the support legs 40 have been permanently deformed in the Z axis and act as springs to maintain the central areas 36 in a plane displaced from the plane of sheet 22 or circuit board 19. When pressure is applied along the Z axis, as by the action of a key rod on a central key area 36, the central key area 36 moves downward. The portion 38 of reduced thickness of the supporting legs 40 allows the central portion 36 to move downward prior to the support legs moving downward, and this allows the central area 36 to move below the plane of the metal sheet 22 or circuit board 19 prior to the legs 40 moving through that plane. Due to the shape of the support legs, which in their deformed state approximate a loxodomical helix, the central area 36 rotates in one direction when initially depressed, due to a downward force applied thereto along the "Z" axis, and then, with further depression past the plane of the sheet 22 or circuit board 19 rotates in the opposite direction. This complex rotary motion causes the switching element to have a force-displacement characteristic with a "negative resistance" characteristic, that is, a portion that requires less force to produce a further displacement of the central area 36.

Figure 5:
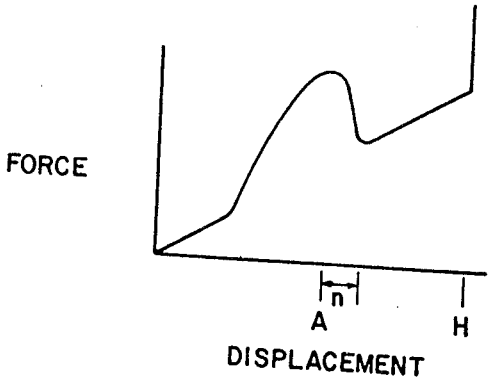
FIG. 5 illustrates the force-displacement characteristics of the switching elements of the devices of FIGS. 2A and 2B.

FIG. 5 shows the force-displacement characteristics of the described form of the switching elements 25 of the present invention. As illustrated, the switching element has a positive force-displacement characteristic until central area 36 passes below the plane of sheet 22 or circuit board 19 (point A) and then has a negative force-displacement characteristic for a short, additional displacement *n*, before once again assuming a positive force-displacement characteristic. For the switching element for which specific dimensions have been given, the portion *n* begins about 1 mm below the plane of sheet 22 and terminates about 3 mm past that plane. Obviously, the negative force-displacement characteristic can be modified by changing the width of indentation 38, or the thickness of legs 40, or the inner or outer terminus of legs 40. The change from a positive force-displacement characteristic to a negative force-displacement characteristic produces a sensory feedback signal through the fingers of the key or switch operator, which indicates to the operator that the key has been depressed a distance sufficient to achieve a desired switching action. Since this action occurs prior to a hard stop condition, displacement H of FIG. 5, the operator can be assured that the switches are activated without the tedious and annoying hard stop condition achieved with prior art switching devices. Obviously, the switches of the present invention can be used either for contact switching in which a switching element 25 and a contact 32 of FIG. 2B would meet, or for capacitive switching wherein the element 25 or 25' would only approach contact 32 to provide a change in capacitance which would be sensed by conventional circuitry to produce a switching action. When used as a capacitive swith, a thin insulating layer may be applied over contacts 32 to prevent shorting.

Figure 6:
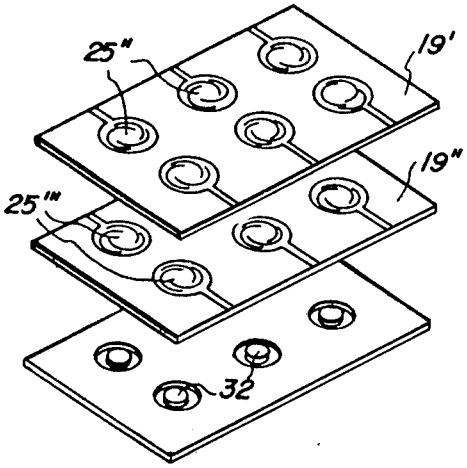
FIG. 6 is a side view of switching devices for multiple switching.
Figure 7:
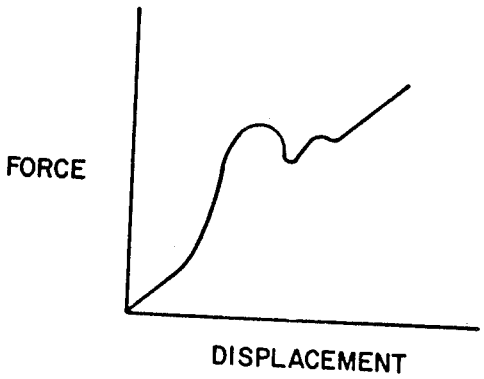
FIG. 7 illustrates the force-displacement characteristics of the device of FIG. 6.

Instead of using only one of my novel switching devices, two such devices may be used in tandem to produce a desired force-displacement characteristic or multiple switching. Such a structure is shown in FIG. 6 which is comprised of two circuit boards 19' and 19'' which are substantially identical to board 19. The first movable contact element 25'' is depressed until it hits the movable contact element 25''' therebeneath at which time both contacts would move until fixed contact 32 is reached. Thus, an output signal is generated from element 25''' when element 25'' contacts it and a second output is generated when element 25''' contacts contact 32. By adjusting the force-displacement characteristics of each of the spring contacts 25'' and 25''', a wide variety of total force-displacement characteristics can be produced which are desirable to the switch or keyboard operator. The force-displacement characteristics of the device of FIG. 6 is shown in FIG. 7. Also, in FIG. 6, a thin insulating layer could cover contacts 25''' and 32 such that capacitive switching can be achieved. Also, the non-planar integral conductive switch of the present invention can be used in conjunction with a planar spring switch, such as that described in the previously mentioned copending application, or a " snap" switch such as that described in U.S. Pat. No. 3,643,041.

What I claim is:

1. A method of making a switching device from a continuous, planar sheet of metallic material with the switching device characterized by a substantially planar, movable central portion coupled to a substantially planar peripheral supporting portion by a plurality of non-planar support legs with the central portion retaining its shape while effecting a switching action, the steps of:

forming in a planar sheet of metallic material a plurality of curved, unconnected slots of substantially uniform width, each of said slots having a smooth curvature and each of said slots radiating outwardly from a central portion of said sheet of metallic material to a peripheral portion of said sheet of metallic material, at least a portion of each of said slots being adjacent at least a portion of at least another of said slots, and plastically deforming into the shape of heliclines only the portions of said sheet of metallic material between said adjacent slots such that said central portion of said sheet of metallic material is supported above the peripheral portion of said sheet of metallic material by said portions of said sheet of metallic material between said adjacent slots with said central portion of said sheet of metallic material being in a plane parallel to the plane of said peripheral portion of said sheet of metallic material.

2. The method of claim 1 including the additional step of precipitation hardening said plastically deformed portions.

* * * * *